US005186631A

United States Patent [19]

Okutsu

[11] Patent Number: 5,186,631

[45] Date of Patent: Feb. 16, 1993

[54] MAGNETIC DISPLAY DEVICE

[75] Inventor: Hiroyasu Okutsu, Zama, Japan

[73] Assignee: Kabushiki Kaisha Pilot, Tokyo, Japan

[21] Appl. No.: 861,565

[22] Filed: Apr. 1, 1992

[30] Foreign Application Priority Data

Apr. 5, 1991 [JP] Japan ..... 3-31196[U]
Aug. 26, 1991 [JP] Japan ..... 3-75193[U]
Nov. 26, 1991 [JP] Japan ..... 3-104742[U]

[51] Int. Cl.[5] ..... B43L 1/00

[52] U.S. Cl. ..... 434/409; 40/240; 40/426; 40/449; 434/408

[58] Field of Search ..... 40/426, 449, 240; 434/405, 408, 409, 413, 416, 420, 421, 85

[56] References Cited

U.S. PATENT DOCUMENTS 2,779,107 1/1957 Brace ..... 434/405
4,143,472 3/1979 Murata .
4,288,936 9/1981 Okutsu ..... 40/426
4,675,476 6/1987 Kobayashi ..... 434/409 X
4,797,106 1/1989 Umehara et al. ..... 434/408
4,804,327 2/1989 Miller ..... 434/409
5,057,363 10/1991 Nakanishi ..... 434/409 X

FOREIGN PATENT DOCUMENTS 57-36477 10/1981 Japan .
2214137 8/1989 United Kingdom ..... 434/409

*Primary Examiner*—Cary E. O'Connor
*Assistant Examiner*—L. Thomas
*Attorney, Agent, or Firm*—Ladas & Parry

[57] ABSTRACT

A magnetic display device having a case in which a magnetic display panel is fixedly mounted. To erase the magnetic display on the display panel, an eraser magnet mounted on a vertically elongated eraser mounting member is moved horizontally along the rear surface of the display panel, by means of a knob projecting forwardly from the mounting member. The case has a rear frame on the forward side of which are provided a pair of parallel horizontal racks. The eraser mounting member has on the rear surface thereof a pair of rotatable pinions which mesh with the racks, respectively. As the mounting member is manipulated horizontally by means of the knob, the pinions rotate along the respective racks and the mounting member is moved smoothly in the horizontal direction.

10 Claims, 6 Drawing Sheets

MAGNETIC DISPLAY DEVICE

BACKGROUND OF THE INVENTION

The present invention relates to a display device having a magnetic panel that performs display and erase by the action of a magnetic field.

Magnetic display devices that can perform the display of characters and graphics on a magnetic panel screen by the action of a magnetic field to the magnetic panel are known as disclosed in U.S. Pat. No. 4,143,472 to Murata et al. The magnetic panel is transparent or translucent and contains a plastic liquid which includes dispersed magnetic particles. The display on the magnetic panel can be erased by the operation of an eraser magnet slidable on the rear surface of the magnetic panel. For the operation of the eraser magnet there is provided an eraser assembly that comprises an eraser mounting member to which the eraser magnet is mounted, and a carriage that moves the eraser mounting member either automatically or manually. As a manually operated eraser assembly, a structure is known wherein an eraser mounting member to which an eraser magnet is mounted, has distal end portions engaging respectively with guide bars or guide grooves provided to a frame of a display device along opposite horizontal edges of the magnetic panel, and wherein a knob is provided on the eraser mounting member so that when the knob is operated the eraser mounting member is moved horizontally, while being guided by either the guide bars or the guide grooves.

In an eraser assembly having such a structure, when the dimension in the vertical direction of the magnetic panel, which is perpendicular to the direction of movement of the eraser mounting member increases, the length of the eraser mounting assembly in that same direction also increases. When the eraser mounting member is moved horizontally by sliding the knob provided thereon, a problem occurs in that the force of friction due to the sliding contact of the portions of the eraser mounting member that engage with the members forming the guide grooves or the guide bars causes the motion of the distal end portions farthest from the knob to be slower, and therefore the eraser mounting member has a tendency to be deformed in a direction opposite to the direction of movement. As a result, the force of friction between the portions of the eraser mounting member that engage with the members forming the guide grooves or the guide bars tends to become even larger. For this reason, the resistance to the movement of the eraser mounting member itself also increases so that it is necessary to have a large force to move the eraser assembly, which prevents the smooth movement of the eraser assembly.

SUMMARY OF THE INVENTION

In the light of these problems described above, the present invention has as an object the provision of a display device having a magnetic panel, in which the eraser assembly can be moved smoothly with a small force even for a display device having a magnetic panel of comparatively large dimensions.

According to the present invention, there is provided a magnetic display device having a case, a magnetic display panel fixed in the case, an eraser for erasing magnetic display in the display panel, and an eraser mounting member supporting the eraser, the eraser mounting member being movable along the display panel for causing the eraser to act successively on the display panel to erase the magnetic display, the display device comprising: first and second racks fixedly mounted within the case and extending in parallel relation in the direction of the movement of the eraser mounting member; and first and second pinions rotatably mounted to the eraser mounting member and meshing with the first and second racks, respectively, so as to be movable rotatingly along the racks for causing the eraser mounting member to move along the racks, the first rack and pinion having the same pitch of teeth, the second rack and pinion having the same pitch of teeth, and the first and second pinions having the same pitch circle.

In a wall-mounted magnetic display device, the first and second racks may be respectively fixed parallel to, and adjacent to upper and lower edges of the case of the display device, and the eraser mounting member may have the first and second pinions at upper and lower ends thereof. Furthermore, a horizontal roller guide may be provided to the case. A guide roller mounted on the eraser mounting member is rollingly mounted on the roller guide so that the weight of the eraser mounting member is borne by the roller guide.

In the present invention, the first and second racks may be formed integrally with the case by injection molding or may be formed separately from the case and be fixed to it.

Providing the eraser mounting member with the first and second pinions may be made by mounting these pinions on the same rotary shaft to enable the pinions to rotate coaxially in unison.

It is possible for the eraser mounting member to be moved even more smoothly if the guide roller is mounted to the roller guide provided to the case, and if more than one guide roller are provided on both sides of the roller guide in sandwiched manner.

It is desirable that the eraser mounting member move always perpendicularly with respect to the racks, and in order to achieve this, it is necessary that the eraser mounting member be positioned perpendicularly with respect to the racks when it is first placed on the display device. This can be achieved by providing the first and second racks with the peaks of the teeth thereof opposite each other. The eraser mounting member can be easily mounted to the display device if the tooth peaks and valleys of one rack oppose tooth valleys and peaks of the other rack, respectively. When the tooth pitches of one and the other racks are different, the one rack and the other rack can be provided parallel such that the tooth peaks of both the racks oppose each other at more than one point within a range of one rotation of one and the other pinions, or such that the tooth peaks of one rack oppose tooth valleys of the other rack at more than one point within a range of one rotation of one and the other pinions.

The eraser mounting member may be moved by holding and sliding a knob provided thereon. The force acts largely on a pinion if the knob is provided at a position close to the pinion, and there will be an insufficient engagement between the pinion and the associated rack if the pitch of the pinion and the rack is small and/or if the teeth height of the pinion and rack is small. There is therefore the possibility that the eraser mounting member will not move smoothly. For this reason, either one or the other pair of rack and pinion close to the position of the knob should preferably have a large pitch and/or a large teeth height.

When the eraser mounting member carrying the eraser is slid by the knob, both of the pinions provided to the eraser mounting member will rotate in accordance with their engagement with their respective racks provided to the case and the eraser will erase the display on the magnetic display panel.

In the case of the wall-mounted display panel, the eraser mounting member has its own weight supported by the roller guide so that there is a little moving friction, and it is possible for it to move smoothly.

The nature, utility, and further features of this invention will be more clearly apparent from the following detailed description with respect to preferred embodiments of the invention when read in conjunction with the accompanying drawings.

DESCRIPTION OF THE PREFERRED EMBODIMENTS

Figure 1:
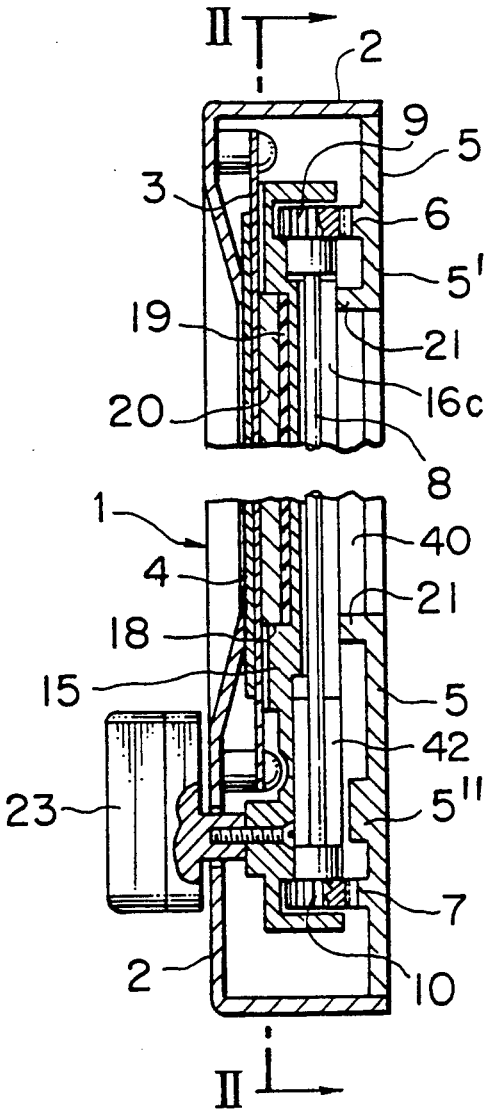
FIG. 1 is a vertical section of a first embodiment of a magnetic panel display device to which the present invention has been applied.

The following is a description of embodiments of the present invention, with reference to the appended drawings. In the figures, corresponding parts and elements are indicated with the same reference numerals.

Figure 2:
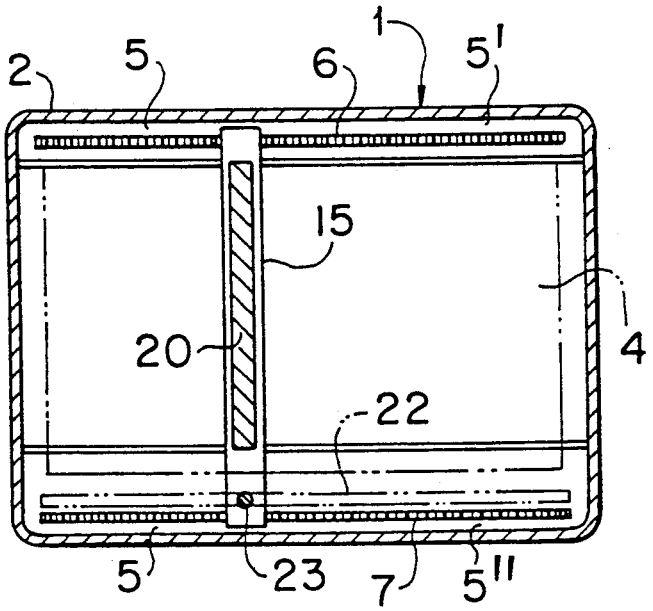
FIG. 2 is a section taken along the line II—II in FIG. 1.
Figure 3:
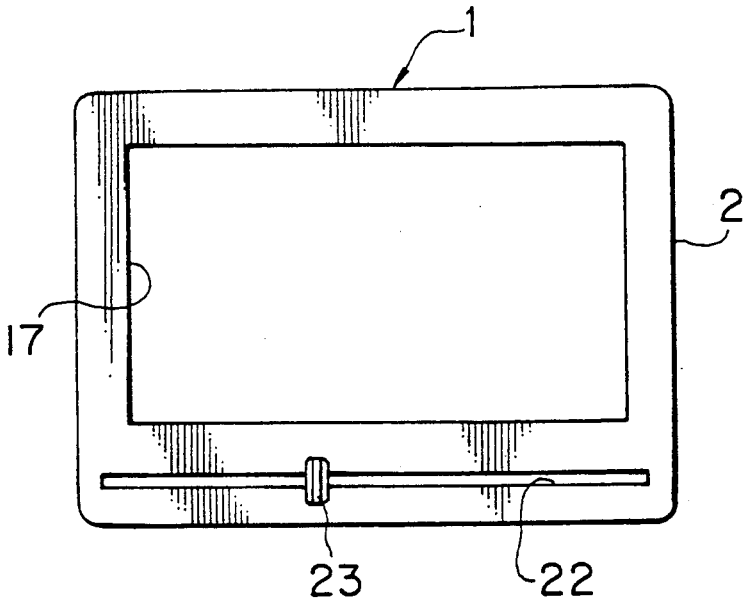
FIG. 3 is a front view of the display device according to the first embodiment.

The description will commence from a description of the embodiment shown in FIG. 1 through FIG. 5. As shown in FIG. 1 and FIG. 3, a display device 1 has a case 2 in the shape of a rectangular box, which has a front display window 17. Inside this case 2 are provided a magnetic display panel 4 that is mounted on the front side (left side as viewed in FIG. 1) of a support plate 3 of a non-magnetic material. To an upper portion 5' of a rear frame 5 fitted in the rear of the case 2, opposite the upper edge of the magnetic panel 4, is fixedly provided a horizontally extending first rack 6 that is slightly longer than the upper edge of the magnetic panel 4 as shown in FIG. 2. To a lower portion 5'' of the frame 5, opposite a lower edge of the magnetic panel 4, is provided a horizontally extending second rack 7 which is slightly longer than the lower edge of the magnetic panel 4, and which has the same pitch of the teeth as that of the first rack 6. The first and second racks 6 and 7 are parallel to each other and are arranged so that the tooth peaks and valleys of these racks 6 and 7 are at vertically corresponding positions. The racks 6 and 7 may be formed integrally with the rear frame 5.

Figure 4:
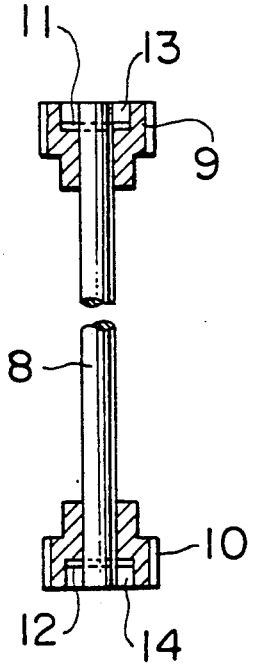
FIG. 4 is a partially sectional elevation of a shaft with pinions used in the first embodiment.

As shown in FIG. 4, upper and lower ends of a vertical shaft 8 have respectively first and second pinions 9 and 10 fixed thereto. The teeth of the pinions 9 and 10 respectively engage with the teeth of the racks 6 and 7. The pinions 9 and 10 have the same pitch and pitch circle. Pins 11 and 12 that pass through the shaft 8 are respectively fitted in a slot 13 of the first pinion 9 and a slot 14 of the second pinion 10.

Figure 5:
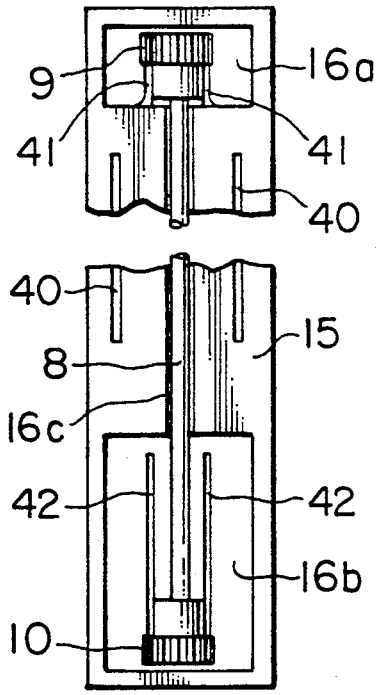
FIG. 5 is an elevation of an eraser mounting member used in the first embodiment.

Within the case 2 is provided a vertically elongated eraser mounting member 15. As shown in FIG. 5, in a rear surface of the eraser mounting member 15 are provided upper and lower recesses **16*a* and 16*b* and a groove 16*c* connecting these recesses. These recesses 16*a* and 16*b* respectively house the pinion 9 and the pinion 10 of the shaft 8 in a manner that they are rotatable within the recesses. The groove 16*c* receives the shaft 8 rotatably therein. The rear surface of the mounting member 15 has upstanding parallel ribs 40. The recesses 16*a* and 16*b* also have parallel ribs 41 and 42, respectively. The ribs 41 and 42 determine relative vertical position between the pinions 9, 10 and the mounting member 15. To the front surface of the eraser mounting member 15 is mounted an eraser magnet 20 which is located in the central portion in the direction of the vertical dimension of the member 15. The eraser magnet 20 is fitted via a resilient member 19 in a vertical groove 18 formed slightly longer than the vertical dimension of the display window 17 of the display device 1**.

The eraser mounting member 15 is so supported in the case 2 with the ribs 40 thereof disposed between horizontally extending protrusions 21 (FIG. 1) of the rear frame 5 that the eraser magnet 20 will slidingly contact the rear surface of the support plate 3 and that the pinions 9 and 10 will mesh with the racks 6 and 7, respectively. The weight of the eraser mounting member 15 is borne by the lower protrusion 21 via the ribs 40. The eraser magnet 20 exerts a magnetic force to the magnetic panel 4 from the rear side of the panel 4 and via the support plate 3.

To a lower end portion of the front surface of the eraser mounting member 15 is fixed a knob 23 which protrudes forwards at a position higher than the lower pinion 10. The knob 23 protrudes to the outside through a slot 22 provided to the case 2, the slot 22 extending parallel to the racks 6 and 7. Erasing the display on the magnetic panel 4 is performed by horizontally sliding the knob 23 so as to move the eraser mounting member 15 horizontally along the racks 6 and 7.

FIGS. 6 through 9 show a second embodiment of the eraser assembly of a display device of wall-mounted type. Inside the case 2' of the display device 1' is mounted a magnetic panel 4 in the same manner as described above for the first embodiment. In addition, in the same manner as in the first embodiment, portions 55' and 55'' of a rear frame 55 provided to the rear of the case 2' are respectively provided with an upper first rack 6 and a lower second rack 7 that are integral with the portions 55' and 55''.

Figure 6:
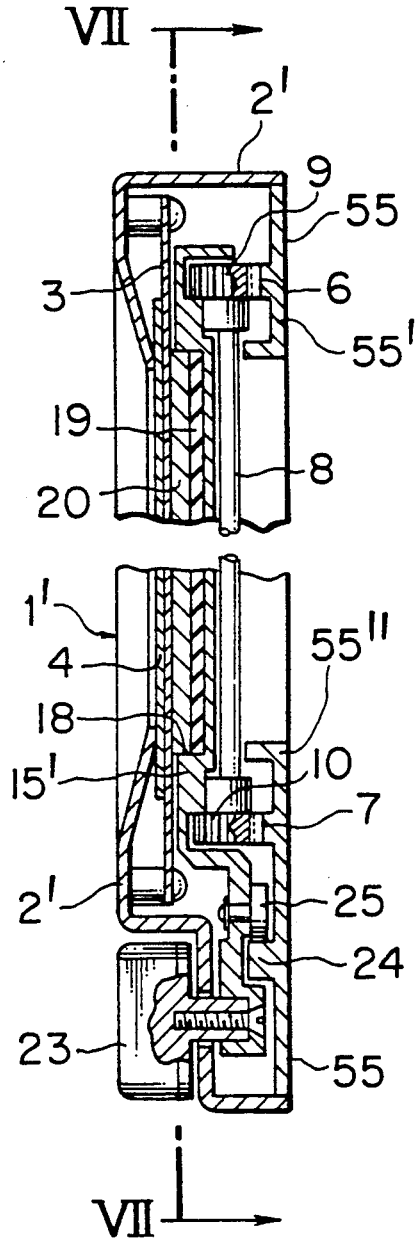
FIG. 6 is a vertical section of a second embodiment of the present invention.
Figure 7:
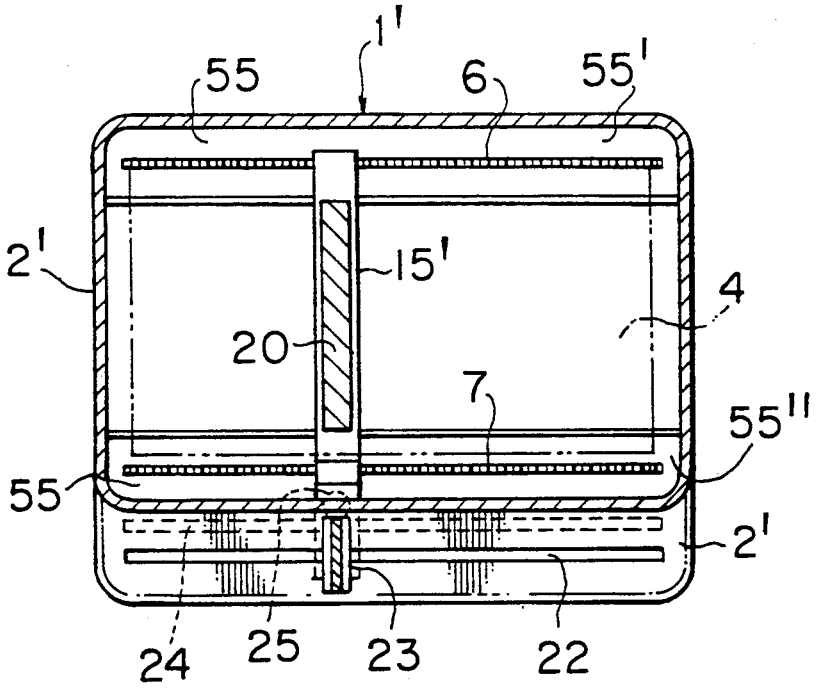
FIG. 7 is a section taken along the line XII—XII of FIG. 6.
Figure 8:
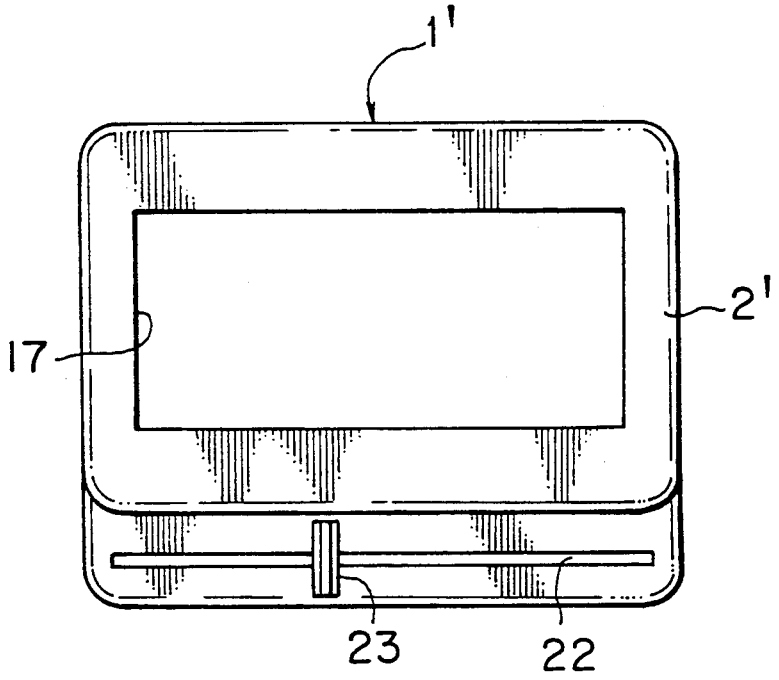
FIG. 8 is a front view of a display device according to the second embodiment.
Figure 9:
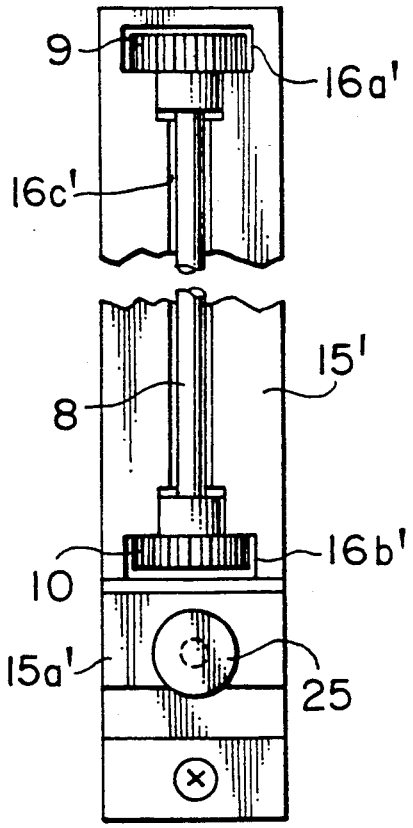
FIG. 9 is an elevation of an eraser mounting member used in the second embodiment.

Also in the same manner as in the first embodiment and as shown in FIG. 9, the rear surface of an eraser mounting member 15' is provided with recesses **16*a*' and 16*b*'** formed adjacent to the upper and lower ends of the member 15'. These recesses 16a' and 16b' house a first pinion 9 and a second pinion 10, respectively, in the same manner as described for the first embodiment. Recess 16c' connects recesses 16a' and 16b'. To the upper and lower ends of a shaft 8 are respectively mounted the first pinion 9 and the second pinion 10. As shown in FIG. 6, below the second rack 7 is disposed a guide roller 25 that rides on a forwardly projecting roller guide 24 which is parallel to the rack 7 and has the same horizontal length as the rack 7. The eraser mounting member 15' has a lower portion 15a' bent rearwards under the lower pinion 10 to rotatably mount the guide roller 25. On the front surface of the eraser mounting member 15' is mounted an eraser magnet 20 in the same manner as in the first embodiment.

The eraser mounting member 15' is arranged inside the case 2' such that the eraser magnet 20 is in sliding contact with the rear surface of a support plate 3, that the guide roller 25 is supported on the roller guide 24, and that the pinions 9 and 10 respectively mesh with the racks 6 and 7. The eraser magnet 20 exerts a magnetic force with respect to the magnetic panel 4 from the rear of the magnetic panel 4 and via the support plate 3.

To the lower end portion of the front surface of the eraser mounting member 15' is provided a knob 23 for horizontally sliding the eraser mounting member 15'. This knob 23 protrudes through a slot 22 which is provided in the case 2' so as to be parallel to the racks 6 and 7.

As shown in FIG. 6, the lower end portion of the case 2' that is provided with the slot 22 is formed thinner than the other portion by the protruding length of the knob 23 beyond the slot 22, so that the knob 23 does not protrude forwards beyond the display window 17.

Erasing the display on the magnetic panel 4 is performed in the same manner as in the first embodiment.

The display device is configured as described above and the action of the racks and pinions enables the eraser assembly to be moved smoothly with only a slight force.

In addition, in the wall mounted display device, even if the weight of the eraser assembly increases because of an increase in size resulting from a large size of the display device, the eraser assembly has its weight supported by the guide roller whereby the movement of the eraser assembly does not become duller due to the weight of the eraser assembly itself, and the knob can be held and operated by one hand with only a slight increase in force to enable smooth movement of the eraser assembly.

Figure 10:
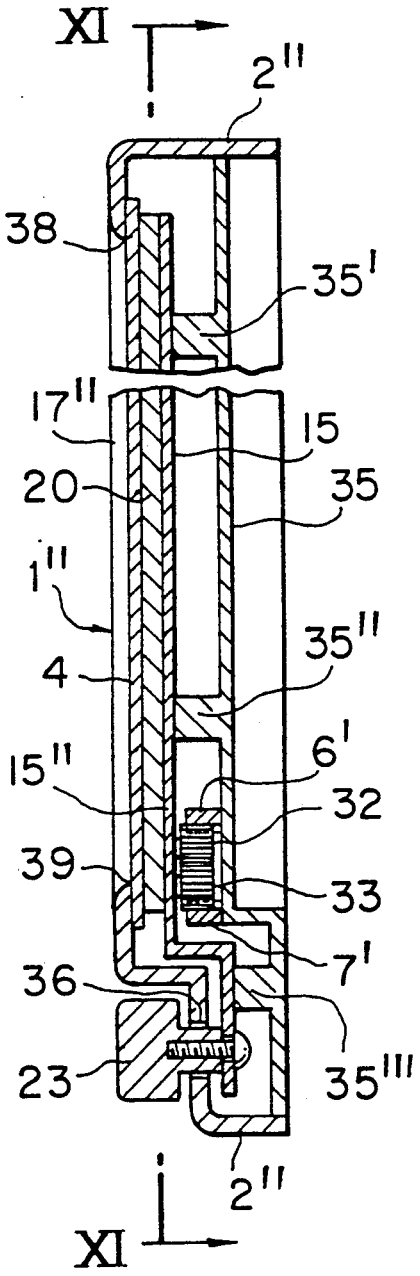
FIG. 10 is a view similar to FIG. 1, showing a third embodiment of the present invention.
Figure 11:
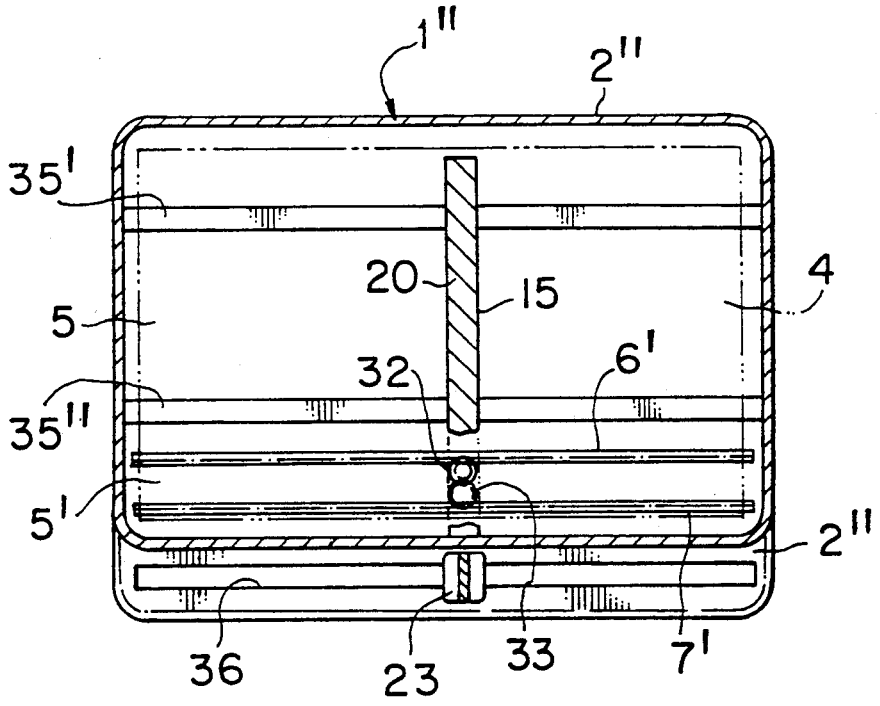
FIG. 11 is a sectional view taken long the line XI—XI in FIG. 10.
Figure 12:
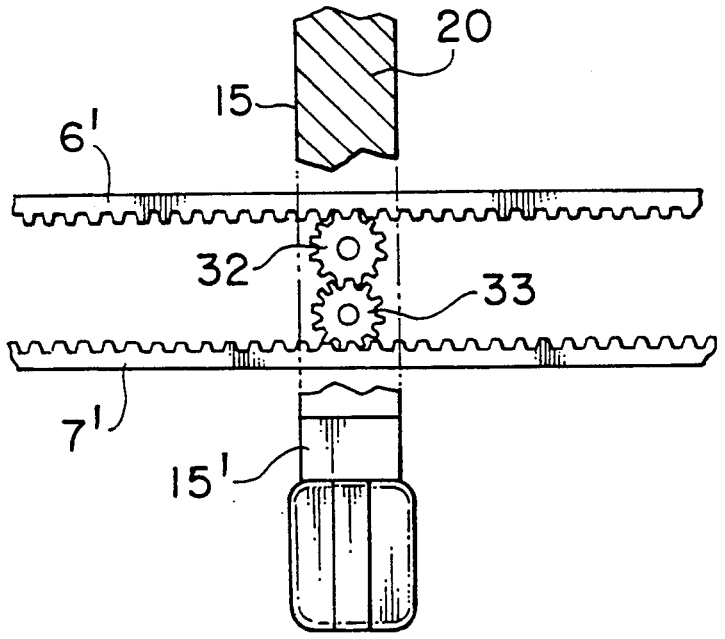
FIG. 12 is a view, on an enlarged scale, showing pinions and racks used in the third embodiment.

FIGS. 10 through 12 show a third embodiment of the present invention. In this embodiment as well, a front display window 17" is provided to a case 2" of a display device 1", and a magnetic panel 4 is mounted inside the case 2". To the rear of the magnetic panel 4 is positioned an eraser magnet 20 and this eraser magnet 20 is supported by an eraser mounting member 15 which is elongated vertically.

To a rear portion inside the case 2" of the display device 1" is fixed a rear frame 35 and to a lower portion of the frame 35 are provided two horizontally extending first and second racks 6' and 7' with teeth that have the same pitch. These racks 6' and 7' are provided parallel to top and bottom edges 38 and 39 of the front display window 17". The racks 6' and 7' are provided facing the inside with a gap therebetween and with the teeth thereof opposing each other.

Vertically aligned first and second pinions 32 and 33 are rotatably mounted on the rear surface of a lower portion 15" of the eraser mounting member 15 that supports the eraser magnet 20 on the front side thereof. These pinions 32 and 33 mesh with each other as indicated in FIG. 12 and have teeth of the same pitch as the first and second racks 6' and 7'. The pinions 32 and 33 are disposed between, and mesh with the racks 6' and 7', respectively. To the lower end of the eraser mounting member 15 is provided a knob 23 which is held by hand when the mounting member 15 is moved horizontally. The knob 23 is passed through a horizontal slot 36.

The above stated members are assembled in the following manner. The pinions 32 and 33 are respectively engaged with the racks 6' and 7', and the eraser mounting member 15 is slidably backed up by forwardly protruding supports 35', 35" and 35"' provided to the rear frame 35. The eraser magnet 20 is supported by the mounting member 15 so that it is always in sliding contact with the rear surface of the magnetic panel 4.

In this embodiment, a small force enables the action of the racks and pinions to smoothly move the eraser mounting member 15 to which the eraser magnet 20 is mounted. The mounting member 15 does not shake in the direction of its length since the pinions are in mesh with the racks provided on the rear frame 35.

What is claimed is:

1. A magnetic display device having a case, a magnetic display panel fixed in the case, an eraser for erasing magnetic display in the display panel, and an eraser mounting member supporting said eraser, said eraser mounting member being movable along the display panel for causing the eraser to act successively on the display panel to erase the magnetic display, said display device comprising:

first and second racks fixedly mounted within said case and extending in parallel relation in the direction of the movement of the eraser mounting member; and first and second pinions rotatably mounted to the eraser mounting member and meshing with said first and second racks, respectively, so as to be movable rotatingly along the racks for causing the eraser mounting member to move along the racks, said first rack and pinion having the same pitch of teeth, said second rack and pinion having the same pitch of teeth, and said first and second pinions having the same pitch circle.

2. The magnetic display device according to claim 1, wherein said case has a rear frame on which said first and second racks are provided.

3. The magnetic display device according to claim 1, wherein said first and second racks extend horizontally and are disposed along upper and lower edges of the case.

4. The magnetic display device according to claim 3, wherein said first and second racks have teeth directed forwardly toward the display panel, and the first and second pinions are mounted on an upper and lower parts of the eraser mounting member, respectively.

5. The magnetic display device according to claim 4, further comprising a vertical shaft rotatably supported on the eraser mounting member and having said first and second pinions fixed to upper and lower ends thereof.

6. The magnetic display device according to claim 5, wherein said eraser mounting member has a rear surface provided with spaced recesses and a groove connecting the recesses, said pinions and shaft being rotatably received within said recesses and groove, respectively.

7. The magnetic display device according to claim 3, further comprising guide roller means rotatably provided on the eraser mounting frame, and horizontal roller guide means on the case, said guide roller means and hence the eraser mounting frame being guided by said roller guide means.

8. The magnetic display device according to claim 1, wherein said first and second racks extend in opposed relation with a gap therebetween and have teeth directed toward those of the other rack, and wherein said first and second pinions are disposed within said gap and mesh with each other.

9. The magnetic display device according to claim 8, wherein said first and second racks extend horizontally and are disposed along a lower edge of the case.

10. The magnetic display device according to claim 2, wherein said rear frame has forwardly protruding support means for supporting the eraser mounting member.

* * * * *